US011950627B2

(12) United States Patent
Dabaghy

(10) Patent No.: US 11,950,627 B2
(45) Date of Patent: Apr. 9, 2024

(54) HEAT MANAGEMENT SYSTEM AND DEVICE

(71) Applicant: Sharbel Issam Dabaghy, El Metn (LB)

(72) Inventor: Sharbel Issam Dabaghy, El Metn (LB)

( * ) Notice: Subject to any disclaimer, the term of this patent is extended or adjusted under 35 U.S.C. 154(b) by 627 days.

(21) Appl. No.: 16/681,066

(22) Filed: Nov. 12, 2019

(65) Prior Publication Data

US 2021/0137157 A1 May 13, 2021

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 4,133,318 A 1/1979 Gross et al.
6,354,301 B2 3/2002 McCoy
7,827,995 B2 11/2010 Chaqui
8,459,269 B2 6/2013 Zoumut
8,590,541 B2 11/2013 Mehio
2007/0056599 A1 3/2007 Zoumut
2010/0101590 A1* 4/2010 Pflaum ..... A24F 1/30 131/222
2010/0212679 A1 8/2010 Bishara
2010/0275937 A1* 11/2010 Shakouri Moghadam ..... A24F 1/30 131/196
2014/0026902 A1* 1/2014 Dabes ..... A24F 1/30 131/226
2014/0255014 A1* 9/2014 Bishara ..... F24H 3/002 392/488
2016/0143353 A1 5/2016 Bavar
2017/0099873 A1* 4/2017 Benjamignan ..... A24F 1/30
2018/0317545 A1 11/2018 Bavar et al.

FOREIGN PATENT DOCUMENTS

EP 2858520 B1 7/2018

* cited by examiner

*Primary Examiner* — Kelly M Gambetta
*Assistant Examiner* — Katherine A Will

(57) ABSTRACT

The present invention relates to a heat management system which utilizes a device that provides for indirect multifaceted heating. The said device creates at least two regions of varying pressure within the system, hence enabling airflow through the device from the area of higher pressure to that of lower pressure. Furthermore, the system of the device creates at least two regions of varying temperatures, thus minimizing heavy burn by cooling the heated air passing through the system, and in particular through the burning smokable material.

17 Claims, 3 Drawing Sheets

HEAT MANAGEMENT SYSTEM AND DEVICE

BACKGROUND OF THE INVENTION

Field of the Invention

The present invention relates to an indirect adaptable heat management device and system for use in a number of applications. For the purpose of the application, a specific embodiment relating to smoking, and more specifically to water pipes, hookahs, arguilehs and other similar devices. For simplification, all further reference to these latter devices will be limited to the term hookah.

Description of the Related Art

Smoking any type of device or article such as cigarettes, cigars, pipes or hookahs, etc. requires the use of some sort of heat generation which enables burning of the smokable material. It is well known in the field that direct burning has many disadvantages such as excess heat, creating increased harmful radicals, increase risks of burning, so on and so forth. Form a user experience, direct burning creates a number of negative experiences such as high heat close to the mouth, bitter taste of burning, hot smoke inhaled into the palate and throat causing irritation in the mouth and throat areas.

A number of so called heat management devices have been disclosed in the prior art. Several patent applications and patents disclose various heat management devices or systems to enhance the smoking experience.

As an example, European patent EP2858520 discloses a solution for managing the heat for tobacco burning. This heat management device depends on a closed pot that towers over the tobacco funnel and is in direct contact with it. Rotating the lid/cover of the charcoal container releases the accumulated heat inside the container to manage the heat. In this system, the charcoal or heat device is always directly touching the base of the container, which in turn is in constant direct contact with the smokable material in the funnel beneath it. For the reasons above, the term heat management is hardly an accurate description because the source of heat is in direct contact with the smokable material container, and the management of heat is not efficient. In addition, the source of heat is in a static position and the heat source amount can neither be increased (if more heat is required) nor decreased (which would result in less smoke); hence the management of heat becomes obstructed by the limitation of the shape, size and position of the heat source container, which is the heat source of this device.

U.S. Pat. No. 4,133,318 discloses another heat management option, which is electric, yet here again, is in direct contact with the tobacco container. The proposed system of '318 lacks the ability of managing the amount of heat, as the heat of the electric coil cannot be modified nor adjusted. It is constant and continuous all the time, unless switched on or off, hence offering a very limited form of heat management.

The closest art which may be considered in relation to this invention is disclosed by abandoned US patent application published under US20070056599. The said publication attempted to address a number of solutions of traditional hookahs such as a side heated hookah bowl, wherein the heat source, i.e. charcoal, is placed adjacent to the side of the tobacco funnel, yet in direct contact thereof, with the purpose to eliminate the dangerous fumes caused by heating the funnel cover, and to prevent ashes from mixing into the tobacco thus altering the flavor. The disclosed side heat hookah bowl heats the tobacco at a much slower rate, and hence produces less smoke and causes inefficient burning of the tobacco.

None of the prior art documents provide a true heat management system however to address the major defects in current and proposed hookahs. The ability to control the amount of heat passing through the smokable material and in particular, separating the heat source from the smokable material, thus creating indirect, manageable and controlled heating.

SUMMARY OF THE INVENTION

Therefore, it is an object of the present invention to provide a true heat management system that is adapted to be universal and fit any hookah model, which is simple to operate and designed to provide true heat management without burning or altering the real flavor of the smokable material. The system of the proposed device operates in a way that helps in cooling the smoke emanating from the smokable material, even prior to further cooling as the smoke travels through the hookah and water, thus creating a truly clean and refreshing smoking experience.

The present disclosure describes a unique tobacco container with an embossed pattern design to provide a uniform heat distribution in case the heat source may, for any reason, result in a lesser heat on any of the said container's sections. In addition, the present invention discloses a heat source tray on which said heat source may be positioned, and wherein said tray can rotate around said container. Said tray may be of varying shape and size to enhance even further the heat management system of the present disclosure.

The device of the proposed heat management system comprises multiple components which can be easily detached and re-attached to form the final device. The device is composed of adequately heat conducting material and the shape of the said components is designed to promote an improved heat management system.

BRIEF DESCRIPTION OF THE DRAWINGS

The invention will be described with reference to the accompanying drawings, which illustrate a preferred embodiment of the present invention without restricting the scope of the invention thereof, and in which.

DETAILED DESCRIPTION OF THE INVENTION

Figure 1:
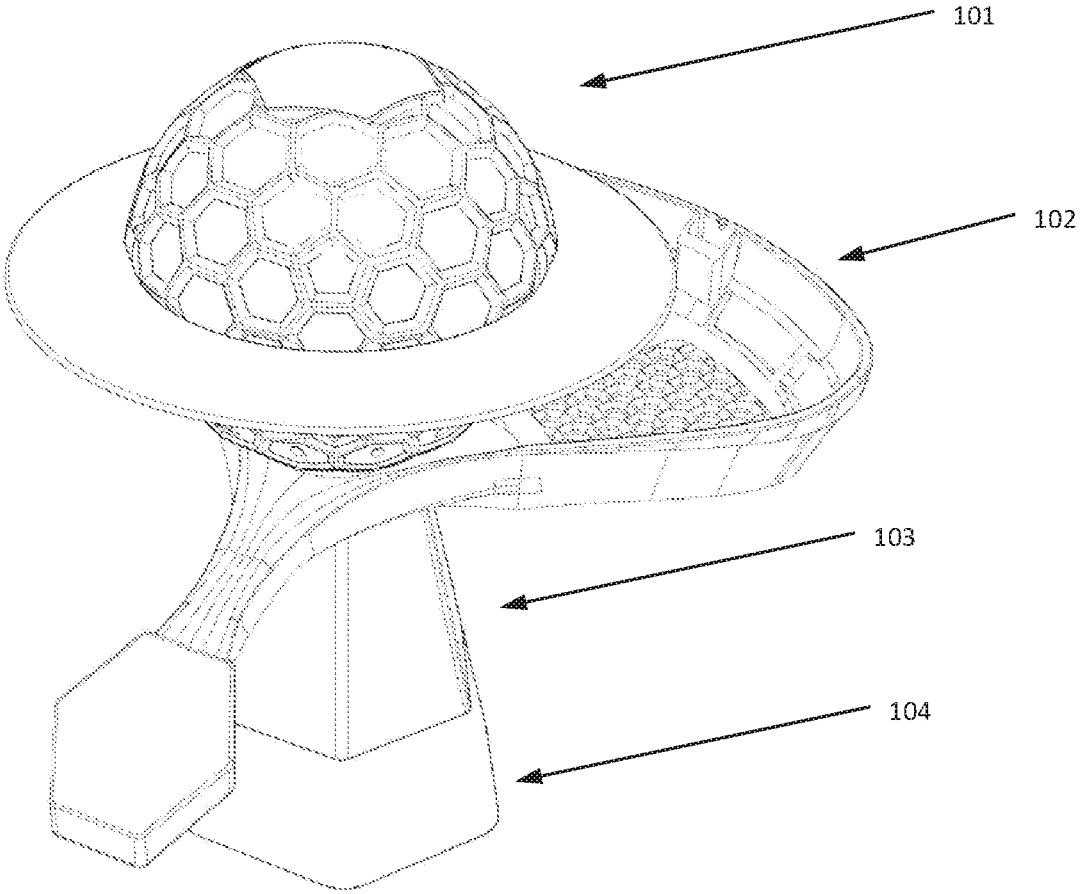
FIG. 1 is a representation of an embodiment of the device of the invention showing the different components which enable the system of the invention.

The present invention helps and guarantees total and even heating, and not burning, of the smokable material during a smoking session. The device of the present invention shown in FIG. 1 comprises a number of distinctive, important and unprecedented features, which enable the system of the present disclosure, which system leads to improvements in a smoking experience. The said device comprises four components which are a container (101) wherein the smokable material is placed, a tray (102) where the heat source sits, a base (103) and an adapter (104). The proposed components will be described herein based on their respective figures where available; as will the system, also based on specific elements of said components which enable the improved and inventive smoking experience.

The figures and descriptions thereof are merely a convenient representation and a preferred embodiment which in no way limit the scope of the invention by size, shape or structure. The embodiments disclosed herein are to facilitate an understanding of the system of the present disclosure, and the proposed device is merely one of many possible embodiments by which said system may be enabled.

One such feature is that for the first time, the user will experience the real taste of the smokable material flavor because this device avoids direct contact between the heat source and the smokable material, especially in the positioning of the heat source itself. As disclosed previously, all traditional smoking systems require burning of the smokable material, which unavoidably affects the composition of the material and hence its taste.

This first feature is enabled in a number of ways as disclosed in the present description. In all prior art, the disclosed devices and heat management systems require that the heat source be placed on top of, below, or around the container holding the smokable material. In all cases, the heat source must come in direct contact with the smokable material, or at least, in direct contact with the walls of the container holding said smokable material. This generally creates excess heating of the material or wall leading to burning of the smokable material.

In a preferred embodiment of the present invention, the heat source is placed on the tray (102). The tray (102) is preferably a flat tray and composed of heat enduring material such as aluminum, ceramic or any other such material which is a resilient to elevated temperatures. The tray is also preferably composed of material which is heat conducting, such as aluminum, ceramic or any other material having thermal conductivity. In brief, it is an embodiment for the present invention for the tray to be composed of material having two indispensable criteria, which are heat resilience and thermal conductivity.

In one embodiment of the present invention, the tray (102) is oblique, or at an angle, with respect to the device. The said angle of the tray (102) is between the horizontal flat or zero angle to an angle which does not exceed an angle where the heat source which is placed on the said tray (102) slides towards the container (101) and thus comes in direct contact with the said container (101). It is submitted herein that the tray (102) may be at an angle of anywhere between +90 degrees to −90 degrees with respect to the plain of the device, provided that the heat source is adequately placed and does not come in direct contact with the wall of the container (101).

Figure 2:
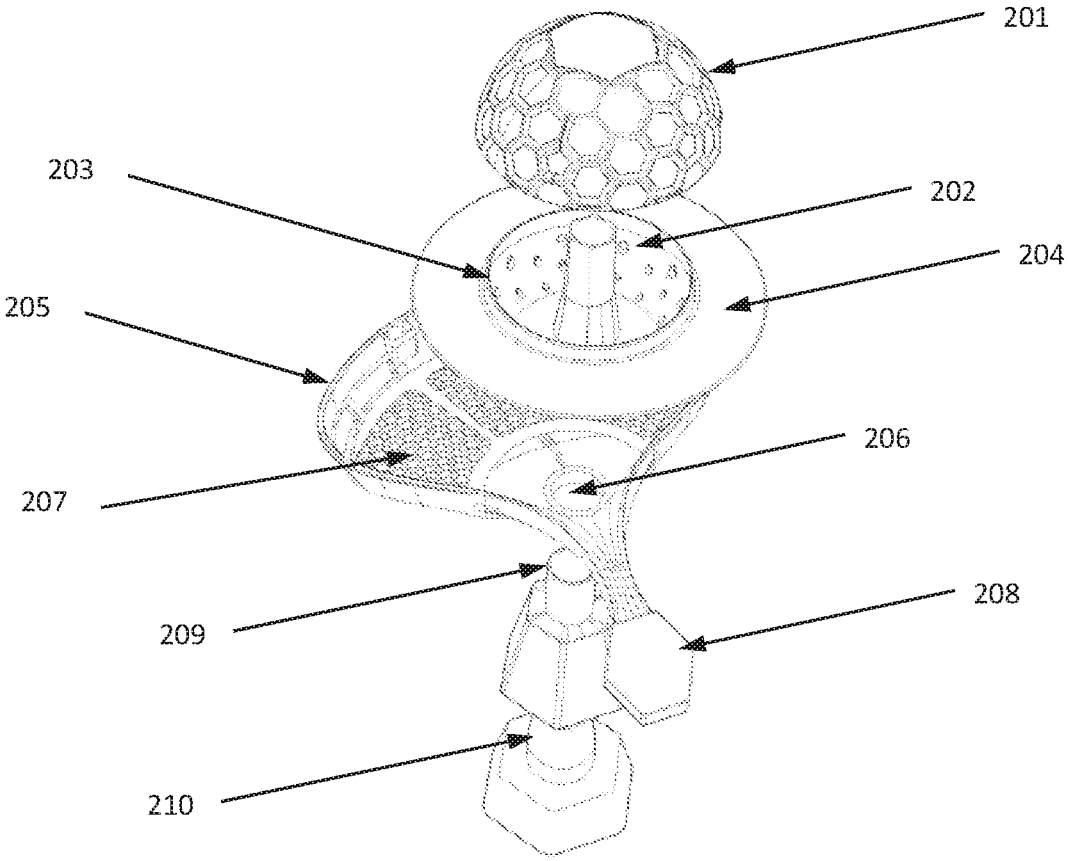
FIG. 2 provides a detailed breakdown of the different components and their features.

In a preferred embodiment of the present invention, the tray (102) comprises a bottom (207), a side wall or rim (205), a handle (208) and a pseudo-centrally positioned opening (206). FIG. 2 represents one embodiment of a shape for said tray (102), notwithstanding that the shape and size of the tray are only limited by the imagination and can be designed to be any shape and size suitable for a specific hookah design or style as desired by a user, as long as the four parts disclosed herein and described herein below are respected.

In a preferred embodiment of the present invention, the bottom of the tray (207) is perforated to allow air to pass through the tray's bottom, which said air will flow through or around the heat source placed on the tray bottom and through the proposed system of the present invention. The flow of air through the said perforations also allows to maintain the heat source lit, especially in cases where said heat source is charcoal or other adequate flammable material. In the case where the heat source is material which lights up and generates ash, the perforated bottom will allow for the disposal of the ashes thus improving the access of air to the said such heat source.

It is also a preferred embodiment of the present invention that the tray has a side wall or rim (205). Said rim (205) acts as a safety feature preventing the heat source from sliding away from the device and off of the tray, thus avoiding any potential hazard. Said rim (205) may be of uniform solid shape or in a preferred embodiment, said rim may contain openings to allow air to flow through for similar reasons as those described for the perforated bottom of said tray.

In a further embodiment of the present invention, the handle (208) of the tray (102) is composed of isolating non-conductive yet heat resistant material such as for example a heat-resistant polymer or plastic or any other such material. The purpose of this composition of the handle (208) will become apparent as described herein below for positioning and handling of the said tray (102) in order to benefit from the improved functionality of optimal and complete heating, hence use, of the smokable material.

As disclosed herein above, the tray also comprises a pseudo-centrally positioned opening (206) which provides for a number of functions. The said opening (206) is used to allow the said tray (102) to be securely positioned within the device and resting on top of the base component (103). The said opening (206) also allows the user to rotate the tray (102) around the axis composed of the central stack (209) of the base component (103). It is thus a preferred embodiment of the present invention for the pseudo-centrally positioned opening (206) to be circular to allow for rotation around the central stack (209) and is snugly fit to the said central stack (209) of the base (103). Whereas the tray (102) is composed of thermal conducting material, the tray handle (208) is composed of non-thermal conducting material, thus allowing the user to safely rotate the tray (102) around the central stack (209) without burning the fingers.

The tray (102) as disclosed in the previously described preferred embodiments rotates around the central stack (209) and thus allows for the re-positioning of the heat source around the container (101) which said container contains the smokable material which will be heated to generate the smoke for the hookah.

The container (101) is composed of at least four distinctive sections: the bottom part (203) which will contain the smokable material, the top part (201) which seals the container to allow the smoke to pass through the system rather than escape, the heat deflector (204) which helps redirect and concentrate the heat back towards the bottom part (203) and the smoke stack (202) through which the smoke flows into the system towards the mouth of the user.

In a preferred embodiment, the container (101) and its different sections are composed of heat resilient and thermal conducting material just like the tray and for the same reasons as the tray. This, with the exception of the top part (201) of the container, which does not necessarily have to have the same material characteristics, whereas in fact, in a preferred embodiment, the top part (201) of the container, may preferably be composed of heat resilient yet non thermal-conducting material to allow further cooling of the flowing smoke inside the container and which smoke comes in direct contact with the top part at all time.

In a yet further preferred embodiment, the walls of the container are multi-layered with each layer composed of a material which enables specific functionalities. In an example, the walls are composed of at least two layers, wherein the inner-most layer is composed of a material which enables the features of the improved smoking system; and wherein the outer-most layer is composed of a material which is impervious to heat or heating and remains cool or bearable to the touch.

In a preferred embodiment of the present invention, the walls of the container (101) may be embossed to form shapes which may provide for an even more optimal heat management of the heat collected inside the said container (101).

In a preferred embodiment of the present invention, the bottom part (203) of the container (101) and the smoke stack (202) are fused in one component. In such an embodiment, the smokable material is placed inside the bottom part (203) and around the smoke stack (202) of the container (101).

It is an aspect of the present invention that the smoke stack's (202) opening sits higher than the smokable material placed around it. Accordingly, the smoke stack (202) inside never leaks juices or other smokable material pieces into the hookah because it is higher than the smokable material's level and is fused to the bottom part (203) of the container (101).

In a preferred embodiment of the present invention, the wall of the bottom part (203) of the container (101) is perforated as needed to allow air to travel across the wall and onto and throughout the smokable material placed inside the bottom part (203) of the container (101). It is submitted that with this embodiment, there will be much more optimal and complete and even heating of the smokable material. In a further preferred embodiment of the present invention, the said perforations on the wall of the bottom part (203) are made such that they allow air to flow into the said bottom part but prevent the leak of material from the smokable material such as juices if molasses tobacco is used.

In an embodiment of the present invention, the heat deflector ring (204) may be a separate piece independent of the bottom part (203) of the container (101). In a yet preferred embodiment, the heat deflector ring (204) is also fused to the bottom part (203) of the container (101).

In a preferred embodiment of the present invention, the heat deflector (204) is composed of heat resilient and thermal conducting material. As can be seen from FIG. 2, the heat deflector ring (204) is positioned above the location where the heat source will rest on the tray bottom (207). It is an aspect of the present invention that the heat generated from the heat source in the direction towards the upper area of the container (101) will be re-directed and reflected towards the bottom part (203) of the said container (101), thus allowing more heat to target the wall of the bottom part (203) and provide further control of the heat directed onto the smokable material. It is submitted herein that this is an essential part of improving the heat management required in the proposed device and system.

The container (101) is thus filled with the smokable material by placing it around the smoke stack (202) and towards the inner walls of the bottom part (203) of the container (101). Then the top part (201) of the container is fitted and the container (101) will be ready for positioning on top of the tray (102) for use as illustrated in FIG. 2.

The two parts (201, 203) of the container (101) may be fitted together by pressing them against each other. They can also be fitted in a screw motion or a plug and rotate motion. The mechanism for fitting the top part (201) to the bottom part (203) is irrelevant as long a seal is created when fitting these two parts together. It is submitted herein as well that by sealing thusly the container (101), no ashes or flying debris can penetrate into the sealed container (101), and thus not affecting the taste of quality of the smokable material.

It is an aspect of the present invention that the container (101), and hence the smokable material, may be easily and safely exchanged. It is submitted that this particular feature is unique to all existing and published art on this matter. The smokable material container is simply fitted using its weight on the central stack (209) extruding from the base (103). It is not screwed nor attached by any hinges or any constricting design; so, by pulling it upwards, it is immediately released and easily replaced, also like nothing else in the world in this domain so far. Most common tobacco containers or funnels are usually tightly fitted to the hookah chassis and are in direct contact with the heat source, thus, they necessitate the removal of the heat source first, and a considerable wait time for adequate cooling down to take place, before attempting to touch or replace the smokable material container itself.

The third part of the herein disclosed device and system is the base (103) which is the part that connects the tray (102) and the container (101) to the hookah's chassis. The top part of the base consists of the central stack (209) which is a tube extending throughout the base and upwards. The opening (206) of the tray (102) fits around this tube which is uses as an axis to rotate around, and the bottom part of the smoke stack (202) which opens up into the bottom part (203) of the container (101) also sits atop and around the said tube. Both the tray (102) and the container (101) fit snugly around the said tube and cause the whole system to be sealed, secure and safe for an efficient sealed device enabling the complete and indirect heating of the smokable material.

Lastly, in a further aspect of the present invention is an adapter (104). Said adapter (104) is composed of flexible heat resistant and non-heat conducting material, which said material may be silicone, rubber or any such similar polymer. The purpose of the adapter (104) is to allow an adequate fit of the proposed device of the present invention to any hookah style or design. The shape and design of the adapter (104) may vary and a preferred shape is shown in FIG. 2 merely to illustrate its functionality.

In a preferred embodiment of the present invention, the adapter (104) is essentially a tube (210) wherein the top part is designed to fit snugly and tightly into the bottom part of the base (103) of the device of the present invention, thus forming a continuous seal through which the smoke travels. The base (103) of the said device sits atop a ledge on the adapter thus securing it in position and preventing it from wobbling or being accidently removed. The bottom part of the adapter then fits on the chassis (not shown) of a hookah, which chassis is generally universal with some very minor exceptions, which makes the device of the present invention compatible for use with all hookahs.

In summary, and as presented by FIG. 2, the preceding described components of the proposed heat management device can easily be assembled and disassembled and adapted to any hookah with the use of the adapter (104) when inserted into the bottom of the device. The said device enables the user a complete and a varied level of heat management, which is described herein below as the heat management system of the present invention.

As is very well known in the art, a hookah is a smoking device whereby smokable material is placed in a container of some sort which container has an opening connected to a tube which tube extends into a receptacle containing water. The smokable material is generally covered with a conducting film such as aluminum, and a heat source, generally lit coal, and is placed on top of the film, which is in direct contact with the smokable material. The hookah device also comprises a hose which at one end is connected to the hookah at a positon above the water level and the other end is inserted in the mouth of the user. when the user aspirates through the hose, a region of negative pressure is created inside the hookah thus aspirating air through the closed system of the hookah, which air helps the coal stay ignited, which in turns burns the smokable material creating smoke, which smoke passes through the tube, into the water then is sucked up through the hose into the user's mouth.

As described above, direct contact of the heat source on the smokable material alters the experience by affecting the smokable material either by changing the flavor and/or creating a burning taste which is uncomfortable on the throat of the user. The charcoal on a hookah as described also creates ash when the charcoal is being consumed, which ash can penetrate and mix with the smokable material thus further affecting the composition thereof. Furthermore, the container holding the smokable material is undoubtedly made of a thermally conductive material which prevents the user from safely touching it to remove for any reason while a smoking session is ongoing, noting that even then, and in order to remove it, it is necessary to remove the heat source first. All of these features for currently existing hookahs make for unsecure, unsafe and often unpleasant experiences.

The proposed heat management system of the present application using the disclosed device provides solutions to all of these defects and enhances the smoking session by folds.

The basic principle of the proposed system using the proposed device is very much similar to the traditional system in that the system is activated by aspiration through a hose which creates a region of lower pressure within the hookah. This lower pressure will aspirate air through the system coming from the only other open section of the system which is the container (101). When air around the container (101) is sucked into the hookah, it will automatically suck in heated air present around the heat source which sits on the tray (102).

Figure 3:
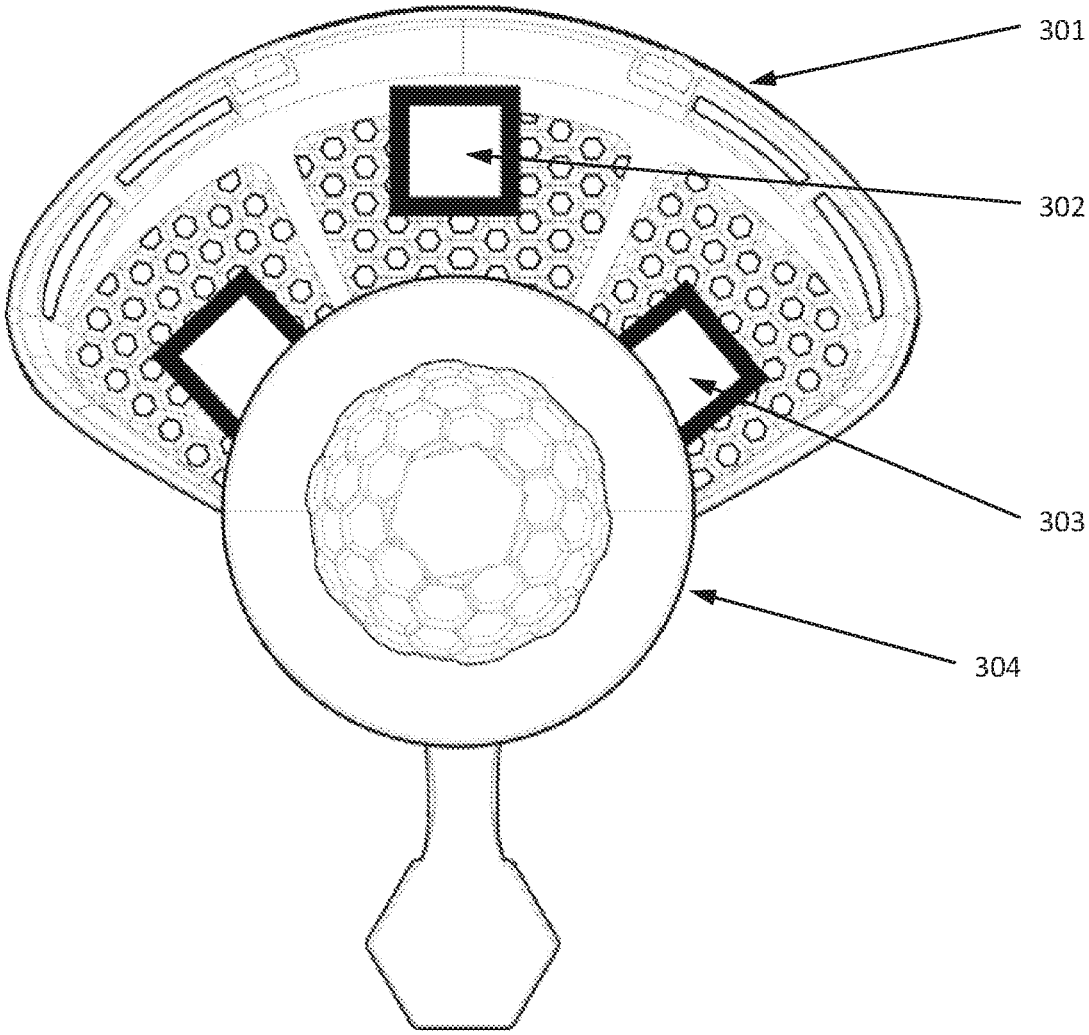
FIG. 3 represents one example of placing one or more heat source on the tray of the device, at one or more different distances from the container holding the smokable material.

As a result of the device of the present invention, heated air will flow through the system only from the section where the tray (102) faces the container (101). As can be surmised from FIG. 3, the heat source, for example 302 and 303, sitting on the tray (301) will only heat the section of the smokable material in the container which is on the same side, i.e. facing the heat source. The smoke will then be generated from the heating of the smokable material of that section only since the remainder of the smokable material is not subjected to heat. As a first advantage, this means that the smokable material is not being consumed randomly and uncontrollably, rather, in sections, as the tray (102) is rotated and the heat source (i.e. 302, 303) with it. As one section of the smokable material is consumed, the user merely rotates the tray to continue smoking with clean and fresh smokable material. Another advantage of this system is that the smoke being sucked into the system will be cooled down. The heated air passing through the container to heat the smokable material will mix with cool air that is being drawn through the perforations in the walls of the container, which are away from the heat source. This is true regardless of the position of the tray as it is rotated around the container (101) on the axis formed by the smoke stack (209) of the base (103).

As a result of the device, the heat source is not in direct contact with the smokable material or its container thus avoiding the burning of the smokable material, and delivering a refreshingly lower temperature smoke which combined, delivers a much more enjoyable smoking experience, on the taste and the throat.

By controlling the heated sections of the proposed device, and providing a mixed temperature of air being aspirated through the system, it is submitted hereby that the defect of randomly and uncontrollably burning of the smokable material has been addressed.

In another embodiment of the present system for heat management, are represented a number of possibilities by which said system can allow a better control of the heat delivered to the smokable material, thus to the overall smoking experience.

Different smokers prefer different intensities when smoking. Said intensity can be controlled by controlling the amount of heat available and from which the smokable material will heat up and release smoke. A user can take advantage of the at least two features available to manage the heat delivery and intensity into the device.

In one aspect of the invention and as described herein above, a user can control the amount of heat in the heat management system by defining the intensity of the heat source such as, for example, increasing or decreasing the number of charcoals, for example 302 and 303, placed on the tray (301). The number and the size of the charcoals in such an embodiment can provide the user with the ability to control the intensity and spread of the heat. The user can use one charcoal, which on the one hand will deliver specific heat intensity and also will affect a smaller portion of the smokable material. By increasing the number of charcoals, the heat intensity can be increased and also the amount of smokable material which is being heated for generating more smoke.

In another aspect of the present invention, a user can control the heat management system by defining the distance of the heat source on the tray (301) from the container (304). The closer the heat source, for example 303, from the container (304) the higher the heat intensity, and the further away from the container it is, for example 302, the lower is the heat intensity.

As can be understood, the present invention offers a true heat management system applicable in this case to hookahs, but the same concept may be applicable to a large number of other applications, noting that the examples used in this disclosure are not intended to limit the applicability to this field alone.

The invention claimed is:

1. A modular heat management device comprising the components of:

a container, a rotary tray, a base, an adapter;

where the rotary tray is located between the container and the base of the heat management device;

where the container comprises a top portion, a bottom portion and a flat ring that extends and surrounds the container and is positioned at the midline of the container where the top and the bottom portions meet;

wherein the rotary tray is composed of tray portion and a handle, and the tray portion covers a segment of the container;

wherein the bottom portion of the container comprises a hollowed out cylindrical shaped funnel.

2. The device according to claim 1, wherein the bottom portion of the container has a plurality of perforations allowing air to flow from the outside of the container.

3. The device according to claim 1, wherein the container is comprised of a plurality of layers.

4. The device according to claim 1, wherein the container has an outside layer that is embossed.

5. The device according to claim 1, wherein the bottom portion and the ring are composed of heat resilient and thermally conductive material.

6. The device according to claim 1, wherein the top portion is composed of a heat resistant and thermally non-conductive material.

7. The device according to claim 1, wherein the bottom portion of the container comprises perforations that are directed inwards.

8. The device according to claim 1, wherein when combined, the top portion of the container, the ring and the bottom portion of the container are assembled to create a seal and reduce the influx of air.

9. The device according to claim 1, wherein the bottom portion of the container can hold smoking material that is placed around the funnel.

10. The device according to claim 1, wherein the tray is composed of heat resilient and thermally conductive material, and comprises a perforated bottom, a hollowed edge rim, an opening, wherein said opening allows the rotation of the tray around a pre-defined axis, and the handle of the rotary tray is composed of a heat resilient and thermally non-conductive material.

11. The device according to claim 1, wherein the base is composed of a heat resilient and thermally conductive material.

12. The device according to claim 1, wherein the adapter is composed of a heat resilient and thermally non-conductive material.

13. A heat management system using the device according to claim 1, wherein charcoal or heat source is placed on the tray portion of the rotary tray such that heat is produced and is lateral to the container providing heat to a portion of the container.

14. The system according to claim 13, wherein the heat intensity is managed by controlling the amount of charcoal or heat source placed on the tray portion and by varying the distance between the charcoal or heat source and the container.

15. The system according to claim 13, where smoking material is placed inside the bottom portion of the container and smoke is generated as a result of heating the smoking material and the perforations located at the bottom portion of the container provide aeration and influx of surrounding air.

16. The system according to claim 13, where smoking material is placed inside the bottom portion of the container and different sections of the smoking material located at the bottom portion of the container can be heated by rotating the tray with the charcoal or heat source.

17. The system according to claim 13, wherein smoking material is placed inside the bottom portion of the container and the smoking material is neither burnt nor contaminated with floating particles or ashes generated.

* * * * *